350-269 SR
10/18/77 XR 4,054,290

United States Patent [19]
Villa

[11] 4,054,290
[45] Oct. 18, 1977

[54] LIGHT GUN HAVING SELECTABLE MODULATED INFRARED OUTPUT

[75] Inventor: Alvaro J. Villa, Northridge, Calif.

[73] Assignee: Walt Disney Productions, Burbank, Calif.

[21] Appl. No.: 697,323

[22] Filed: June 18, 1976

[51] Int. Cl.² ..... A63F 9/02
[52] U.S. Cl. ..... 273/101.1; 350/269
[58] Field of Search ..... 35/25; 240/2 F, 6.41; 273/101.1, 101.2, 102.2 B; 350/269, 315, 167

[56] References Cited

U.S. PATENT DOCUMENTS

| | | | |
|---|---|---|---|
| 2,629,598 | 2/1953 | Hooker | 273/101.1 |
| 2,995,834 | 8/1961 | Rowe | 35/25 |
| 3,493,292 | 2/1970 | Dostal | 350/269 |
| 3,510,216 | 5/1970 | Wagman | 350/167 X |
| 3,549,147 | 12/1970 | Katter | 273/101.1 |
| 3,633,285 | 1/1972 | Sensney | 273/101.1 X |
| 3,655,192 | 4/1972 | Hall et al. | 273/101.1 |
| 3,748,751 | 7/1973 | Breglia et al. | 273/101.1 X |
| 3,918,714 | 11/1975 | Ceccaroni | 273/101.1 |

*Primary Examiner*—Richard C. Pinkham
*Assistant Examiner*—Vance Y. Hum
*Attorney, Agent, or Firm*—Fulwider, Patton, Rieber, Lee & Utecht

[57] ABSTRACT

A light gun for use on moving vehicles produces continuous visible light for aiming purposes and selectable modulated infrared frequencies for actuating a target. The optical path through the gun is transparent to visible light while the infrared portion of the spectrum is modulated by a tuning fork chopper and selectively gated into the optical path by means of an infrared filter, the position of which is controlled by the trigger of the gun.

15 Claims, 4 Drawing Figures

LIGHT GUN HAVING SELECTABLE MODULATED INFRARED OUTPUT

BACKGROUND OF THE INVENTION

1. Field of the Invention

The present invention relates generally to directable light sources and more particularly to light guns utilized in shooting galleries or the like in which the light gun has a trigger control for activating the target when the light beam is properly aligned.

2. Description of the Prior Art

In prior art shooting gallery systems for amusement centers, the shooters are stationary and the light guns typically have simple on-off switches for the light sources which stimulate photosensitive detectors in the targets. The gun is conventionally aimed by placing the shooter's eye close to a sighting device and the light source is on only when the trigger is pulled. Such prior art sighting techniques would be dangerous if the "shooting gallery" included moving vehicles from which the light guns were to be aimed.

Furthermore, the light sources of these prior art guns typically are the same color, making it difficult to differentiate between a plurality of guns aiming at the same target and the targets of such systems are typically sensitive to any light source and spurious target "hits" are common. The light gun system of the present invention alleviates many of these problems in the use of light guns for amusement purposes, particularly shooting galleries with moving vehicles from which the light guns are to be aimed.

SUMMARY OF THE INVENTION

The present invention provides a light gun which has a visible light output which is continuously on for the purpose of aiming the gun at a particular target. Thus, there is no need for a person to sight in the conventional manner, with his eye dangerously close to the gun. In accordance with the invention, the light sources of a plurality of guns may be made different colors so that it is possible to differentiate between a number of light guns aiming at the same target.

The infrared portion of the spectrum from the light source within the gun is modulated at a predetermined frequency and is selectively added to or subtracted from the optical path within the gun. A conventionally designed receiver is sensitive to infrared light modulated at the particular frequency and only that combination will activate the target. Thus, the receiver is substantially insensitive to spurious light sources and interference. Thus, the light gun of the present invention provides continuous visible light and selectable modulated infrared light to activate the target.

In the light gun of the present invention, a tuning fork light chopper having a window including a center portion transparent to both visible and infrared light and two side portions which filter out infrared light. Thus, as the tuning fork vibrates, the infrared light is periodically blocked from the optical path or modulated. The chopper frequency in the presently preferred embodiment is approximately 400 Hertz which is substantially outside the range of spurious infrared sources and other sources of interference such as power line noise.

In the presently preferred embodiment of the invention, the infrared frequencies are continuously modulated and selectively gated into and out of the optical path by means of an infrared filter positioned for movement into and out of the optical path by means of a solenoid under the control of the trigger of the light gun.

DESCRIPTION OF THE PREFERRED EMBODIMENT

Figure 1:
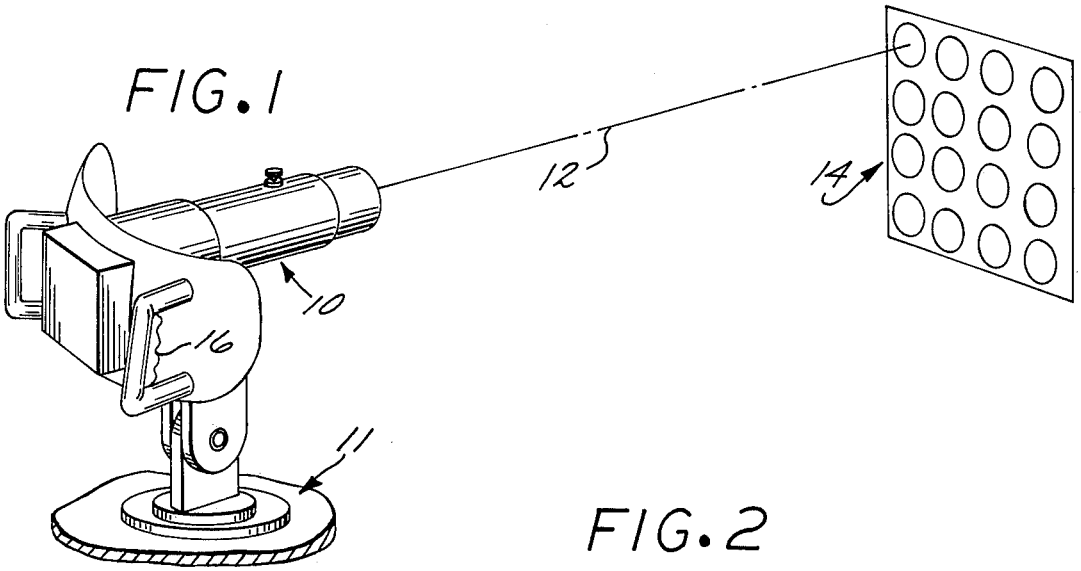
FIG. 1 is a pictorial view of an application of the presently preferred embodiment of the light gun of the invention shown in a typical operating environment and housed in an amusement-type gun format.

Turning now to the drawings, and particularly FIG. 1 thereof, the shooting gallery application for which the light gun of the present invention was designed is pictorially illustrated. In this application, a model gun having any desired configuration, such as a futuristic gun 10, for use on an amusement ride in which the gun platform 11 is on a moving vehicle, increasing the difficulty of aiming the gun. Additionally, it is desirable that the shooter need not to place his eye near the gun 10. Therefore, the gun 10 provides a continuous visible light beam which is aimed at one of a plurality of targets 14 along a predetermined optical path 12. Each particular gun 10 emits a particular color of visible light for identification. When the optical path 12 of the gun 10 is on target, a trigger 16 on the gun 10 is pressed and modulated infrared light is also transmitted along the same optical path 12 to the target 14. The target 14 is activated only by the infrared frequencies which are modulated at a predetermined frequency.

It should be appreciated that the continuous visible light from the gun 10 along the optical path 12 permits safe aiming of the gun from a moving platform 11 in an amusement park ride. In addition, spurious light sources, such as flash bulbs, flash lights and other sources of interference cannot activate the target to indicate a hit.

Figure 2:
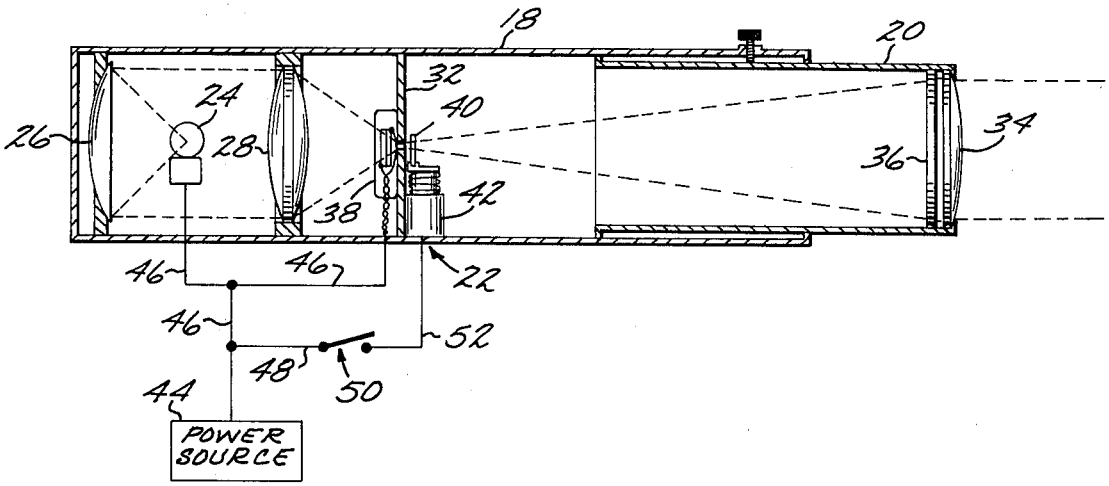
FIG. 2 is a diagrammatic view of the structure of the light gun of the present invention.

Turning now to FIG. 2, the operating mechanism of the light gun 10 of the invention is diagrammatically illustrated. Generally, the light gun 10 includes a conventional optical system housed within a tubular housing 18 which includes a draw tube 20 for focusing the generated light into a narrow beam. The light gun also includes an infrared light control section 22 to modulate and selectively gate the infrared light into and out of the light beam.

The optical system includes a high intensity light source in the form of a lamp 24 which, in the presently preferred embodiment of the invention, is a conventional long-life, high intensity projection lamp and a conventional parabolic reflector 26 which focuses the light from the lamp 24 into a condensing lens 28 which focuses all of the light into a focal point within a relatively small aperture 30 in an opaque plate 32 within the tubular housing 18. The light emanating from the aperture 30 is then focused by a lens 34 into a narrow beam. As noted above, in order to distinguish between the plurality of light guns, the visible light emanating from the gun itself may be of a particular color which may be provided with a color filter 36 within the draw tube 20.

The infrared control section 22 includes a light chopper 38 positioned against the aperture 30 on one side of the plate 32 and an infrared filter 40 positioned by a solenoid 42 mounted adjacent the aperture on the opposite side of the plate 32.

A power source 44 continuously applies power through the lines 46 to the lamp 24 and the chopper 38 so that they are in continuous operation. Power is also supplied to a line 48 through a trigger switch 50 to a line 52 to the solenoid 42 so that the solenoid 42 is actuated only when the trigger switch 50 is closed.

In operation, the lamp 24 generates both visible and infrared light frequencies and the visible portion of the spectrum continuously passes through the optical system to form the visible light beam along the optical path 12. The infrared control system including the chopper 38 and the infrared filter 40 is transparent to visible light.

The infrared spectrum generated by the lamp 24 is first modulated by the chopper 38 and, when the trigger is not depressed, the infrared filter 40 prevents the modulated infrared spectrum from emanating from the gun. When the trigger 50 is depressed, the solenoid 42 moves the infrared filter 40 out of the optical path 12 permitting the modulated infrared spectrum to emanate with the visible light along the optical path 12.

Figure 3:
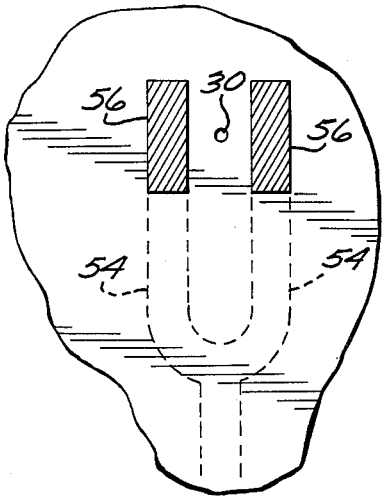
FIG. 3 is a view of the chopper window shown in the direction of the optical path.
Figure 4:
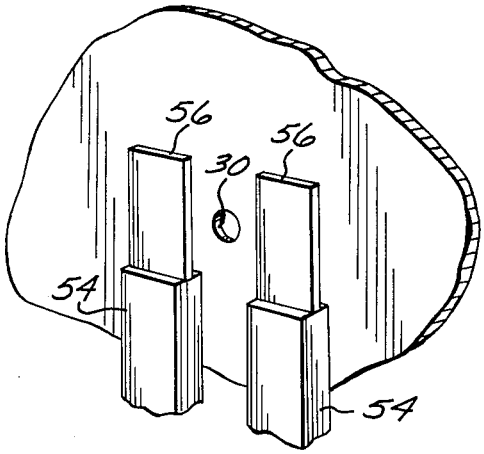
FIG. 4 is a perspective view of a portion of the tuning fork chopper shown in position in front of the aperture of the light gun.

Turning now to FIGS. 3 and 4, the chopper window of the chopper 38 is illustrated in detail. The chopper 38 is a conventional miniature optical chopper available from Bulova Watch Company, Inc., Electronics Division, 61-20 Woodside Ave., Woodside, N.Y. 11377, as Type L8C, which has been modified by the manufacturer to replace the normal opaque shutters with infrared filters. Basically, the optical chopper is a tuning fork mechanism having conventional tines 54 such as are shown in phantom in FIG. 3 and mounted atop the tines are extensions which, in the present application, are infrared filters 56. The tuning fork structure is conventionally driven by electromagnetic means (not shown) so that the infrared filters vibrate into and out of blocking relationship with the aperture 30. The tuning fork structure is mounted adjacent the aperture 30 as shown in FIG. 4, which also illustrates the position of the infrared filters 56 atop the tines 54 of the tuning fork.

The design frequency of operation of the miniature light chopper 38 is approximately 400 Hertz which provides an operating frequency which prevents a substantial amount of possible interference from spuriour light sources and other types of electromagnetic interference such as from power lines.

Thus, the light gun system of the present invention provides a continuous visible light beam for ease in aiming a shooting gallery gun from a moving gun platform, such as a vehicle, and a triggered source of modulated infrared frequencies which activate the receiver. As the target responds only to infrared energy modulated at a predetermined frequency, the target is not activated by spurious light sources or other types of electromagnetic interference.

While the light gun system of the present invention has been described in detail above and a presently preferred embodiment thereof has also been described, it will be appreciated that there may be many modifications to the embodiment and, therefore, the scope of the invention is not to be limited, except by the following claims.

I claim:

1. A light gun comprising:

a source of continuous visible and infrared light directed along a common predetermined path;

means for periodically interrupting said infrared light along said path while passing said visible light; and means for selectively blocking said interrupted infrared light along said path while passing said visible light.

2. A light gun which constantly emits visible light and selectively emits infrared light in response to a human operator pulling a trigger, said light gun comprising:

a source of continuous visible and infrared light directed along a common path predetermined by said operator;

means for modulating said infrared light along said path while permitting said visible light to pass unmodulated; and means for selectively blocking said infrared light along said path in accordance with the pulling of said trigger while permitting said visible light to pass unmodulated.

3. A light gun as defined in claim 2, wherein:

said modulating means includes an optical chopper having an optical window positioned adjacent an aperture in said path, said optical window having a center area substantially transparent to said visible and infrared light and also sections which absorb said infrared light, said optical window being periodically moved across said aperture to periodically align said side sections with said aperture.

4. A light gun which constantly emits visible light and selectively emits infrared light in response to a human operator pulling a trigger, said light gun comprising:

a source of visible and infrared light directed along a path predetermined by said operator;

means for modulating said infrared light along said path; and means for selectively blocking said infrared light along said path in accordance with the pulling of said trigger, said blocking means includes an infrared absorbent filter mounted on the armature of a solenoid, said solenoid being positioned to place said filter in blocking relationship with said aperture when said solenoid is deenergized and to move said filter out of blocking relationship when said solenoid is energized.

5. For use in an amusement park ride in which the ride vehicles include gun platforms with guns aimed at targets while the vehicle is in motion, a light comprising:

light source means for emitting continuous visible and infrared frequencies along a common predetermined path;

means for continuously modulating only said infrared frequencies at a predetermined modulating frequency; and means for selectively blocking only said modulated infrared frequencies while passing said visible frequencies.

6. A light gun as defined in claim 5, wherein:

said means for selectively blocking said infrared frequencies include a manually controlled trigger on said light gun.

7. For use in an amusement park ride in which the ride vehicles include gun platforms with guns which are aimed at targets while the vehicle is in motion, a light gun comprising:

a tubular housing;

light source means for producing light focused at a point along a centerline of said housing, the light from said light source having visible and infrared frequencies;

aperture means positioned along said housing substantially at said point for establishing substantially a point source of light at said point;

infrared modulating means positioned adjacent said aperture for modulating the infrared frequencies from said light source means before they enter said aperture;

selective blocking means positioned adjacent said aperture on the opposite side thereof for selectively blocking said modulated infrared frequencies; and draw tube means telescopingly positioned within said tubular housing at an opposite end thereof, said draw tube means including a lens for focusing light emitting from said aperture substantially into a column.

8. The light gun defined in claim 7 including:

color filter means mounted within said draw tube means.

9. The light gun defined in claim 7, wherein:

said means for selectively blocking includes a manually controlled trigger.

10. The light gun defined in claim 9 including:

color filter means mounted within said draw tube means.

11. The light gun defined in claim 7, wherein:

said light source means includes a parabolic reflector and a condensing lens to focus said light at said point.

12. The light gun defined in claim 7, wherein:

said modulating means includes an optical chopper having an optical window positioned adjacent an aperture in said path, said optical window having a center area substantially transparent to said visible and infrared light and also sections which absorb said infrared light, said optical window being periodically moved across said aperture to periodically align said side sections with said aperture.

13. The light gun defined in claim 12, wherein:

said blocking means includes an infrared absorbent filter mounted on the armature of a solenoid, said solenoid being positioned to place said filter in blocking relationship with said aperture when said solenoid is deenergized and to move said filter out of blocking relationship when said solenoid is energized.

14. The light gun defined in claim 13, wherein:

said means for selectively blocking includes a manually controlled trigger.

15. The light gun defined in claim 14, wherein:

said light source means includes a parabolic reflector and a condensing lens to focus said light at said point.

* * * * *